US006241554B1

(12) United States Patent
Murakami et al.

(10) Patent No.: US 6,241,554 B1
(45) Date of Patent: Jun. 5, 2001

(54) WATERPROOF CONNECTOR AND METHOD OF ASSEMBLING THE SAME

(75) Inventors: Takao Murakami; Masaru Fukuda, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/577,361

(22) Filed: May 23, 2000

(30) Foreign Application Priority Data

Jun. 3, 1999 (JP) ..... 11-156823

(51) Int. Cl.[7] ..... H01R 13/40
(52) U.S. Cl. ..... 439/587
(58) Field of Search ..... 439/595, 190, 439/587, 586, 597, 271

(56) References Cited

U.S. PATENT DOCUMENTS 5,540,450 * 7/1996 Hayashi et al. ..... 277/205
5,859,534 * 1/1999 Saijo et al. ..... 324/538

FOREIGN PATENT DOCUMENTS 11-329571 11/1999 (JP) ..... H01R/13/52
11-354200 12/1999 (JP) ..... H01R/13/52

* cited by examiner

*Primary Examiner*—Brian Sircus
*Assistant Examiner*—Michael C. Zarroli
(74) *Attorney, Agent, or Firm*—Sughrue, Mion, Zinn, Macpeak & Seas, PLLC

(57) ABSTRACT

A waterproof rubber plug has a through hole through which an electric wire is inserted. The electric wire is connected to a terminal. An inner housing has a terminal chamber for accommodating the terminal. An outer housing has sidewalls for defining a chamber provided with a bottom wall, into which the inner housing is fitted. A through hole, through which the electric wire is inserted, is formed on the bottom wall so as to face the terminal chamber when the inner housing is inserted into the chamber of the outer housing. A recess is formed on the bottom wall so as to communicate with the through hole and opened to the outside of the outer housing, into which the rubber plug is fitted after the inner housing is completely fitted into the chamber of the outer housing, thereby sealing the electric wire and the terminal chamber.

5 Claims, 15 Drawing Sheets

WATERPROOF CONNECTOR AND METHOD OF ASSEMBLING THE SAME

BACKGROUND OF THE INVENTION

The present invention relates to a small size multi-way water proof connector with an improved water proof property between a connector housing and a plurality of electric wires connected with terminals, and a method of assembling the same.

A related waterproof connector, which is disclosed in Japanese Patent Publication No. 11-329571, will be explained specifically with reference to FIGS. 8 to 10E. A connector housing 11 of a water proof connector 10" comprises a synthetic resin inner housing 12 having a plurality of terminal chambers 13 formed integrally therewith, a synthetic resin outer housing 17 for fitting the inner housing 12 to the inside thereof, and a synthetic resin spacer 28 disposed between the inner housing 12 and the outer housing 17 for holding female terminals 14 accommodated in each terminal chamber 13 of the inner housing 12.

As shown in FIGS. 8 and 9, the inner housing 12 has a box part 12*a* with the rear side of the upper and lower faces opened, for forming the terminal chambers 13 in a space formed with the center horizontal wall 12*b* and vertical side walls 12*c*, serving also as partition walls in the vertical direction. The female terminals 14 can be accommodated in each terminal chamber 13. Moreover, engagement claws 15 are formed integrally, projecting from both sides and the center of the upper and lower faces of the box part 12*a* as well as flange parts 16 are formed integrally projecting from the front end of the both side center parts. Rectangular insertion holes 12*d* through which female terminals of a mating connector (not illustrated) are inserted are formed in the front wall of the box part 12*a* at a position corresponding to each terminal chamber 13. Furthermore, a pair of press-connecting blades 14*b* are formed by bending each in both side plate parts in the rear part of a box part 14*a* of the female terminals.

As shown in FIGS. 8 and 9, the outer housing 17 has a double box-like shape with the front side opened, with a substantially quadrilateral pipe-like inner wall part 17*a*, a substantially quadrilateral pipe-like outer wall part 17*b* for containing the inner wall part 17*a*, and a bottom wall part 17*c*, connecting the rear parts of the inner and outer wall parts 17*a*, 17*b*. A thick portion is provided in the center of the bottom wall part 17*c*. Rubber plug chambers 19 having a large diameter round cross-section for storing the water proof rubber plugs 18 by press-in are formed at a position corresponding to each terminal chamber 13 at the front side with respect to the thick portion as well as insertion holes 21 having a small diameter round cross-section for inserting electric wires 20 therethrough are formed, communicating with each corresponding rubber plug chamber 19 at the rear side with respect to the thick portion. The water proof rubber plugs 18 have a substantially cylindrical shape with the rugged inner and outer circumferential faces so that the electric wires 20 can be inserted through the inside thereof without having a gap.

Moreover, rectangular engagement holes 22 to be engaged with each engagement claw 15 at both sides of the upper and lower faces of the box part 12*a* of the inner housing 12 are formed at both front sides of the upper and lower walls of the inner wall part 17*a* of the outer housing 17 as well as rectangular longitudinal engagement holes 23 to be engaged with each engagement claw 15 at the center of the upper and lower faces of the box part 12*a* of the inner housing 12 are formed at the front center portion of the upper and lower walls of the inner wall part 17*a*. Furthermore, a V-shaped packing receiving part 25 for receiving an annular rubber water proof packing 24 is formed integrally, projecting from the deep part of the outer face side of the inner wall part 17*a* of the outer housing 17. Tapered faces 26 are formed in the front rim of the inner face side of the inner wall part 17*a* of the outer housing at a position corresponding to each engagement hole 22, 23. Moreover, engagement holes 27 to be engaged with flexible engagement arms of a mating connector (not illustrated) are formed at the front side of the upper and lower walls of the outer wall part 17*b* of the outer housing 17.

As shown in FIGS. 8 and 9, the spacer 28 forms a box-like shape with the front side opened, with a substantially quadrilateral pipe-like body 28 to be fitted with the inner face side of the inner wall part 17*a* of the outer housing 17, a substantially quadrilateral pipe-like brim part 28*b* formed integrally with the front end of the body 28*a*, bent rearward therefrom, to be fitted with the outer face side of the inner wall part 17*a* of the outer housing, and a bottom wall part 28*c* of the body 28*a*.

Accordingly, the box part 12*a* of the inner housing 12 can be fitted into the body 28*a* of the spacer 28. Rib-like projections 29 for preventing fall-off of the terminals are formed integrally, projecting from the inner face of the upper and lower walls of the body 28*a* of the spacer 28, to be engaged with the rear end rim of the box part 14*a* of the female terminals 14 accommodated in each terminal chamber 13.

Moreover, notch portions 30, 31 are formed in the front side of the portion connecting the body 28*a* and the brim part 28*b* of the spacer 28 at a position corresponding to each of the engagement claw 15 and the flange part 16 of the inner housing 12. Engagement claws 32 to be engaged with each engagement hole 23 of the outer housing 17 are formed integrally, projecting form the outer face side of the upper and lower walls of the body 28*a* of the spacer 28 between the upper and lower side notch portions 30. Furthermore, the tip portion of the brim part 28*b* can hold the packing 24 engaged with the packing receiving part 25 of the inner wall part 17*a* of the outer housing 17 when the fitting operation with respect to the outer housing 17 is completed.

Moreover, insertion holes 33 are formed in the bottom wall part 28*c* of the spacer 28 at a position corresponding to each insertion hole 21 of the outer housing 17. Furthermore, the bottom wall part 28*c* of the spacer 28 can hold the rubber plugs 18 inserted in each rubber plug chamber 19 of the bottom wall part 17*c* of the outer housing when the fitting operation with respect to the outer housing 17 is completed. As shown in FIG. 8, each electric wire 20 inserted through each insertion hole 21 of the outer housing 17, each rubber plug 18 and each insertion hole 33 of the spacer 28 is press-connected between the pair of the press-connecting blades 14*b*, 14*b* of each female terminal accommodated in each terminal chamber 13 of the inner housing 12 so that each terminal chamber 13 and each electric wire 20 are sealed with the rubber plug 18 and the packing 24, respectively.

In assembling the water proof connector 10" with the above-mentioned configuration, as shown in FIG. 10A, the rubber plugs 18 are inserted and set in each rubber plug chamber 19 inside the bottom wall part 17*c* of the outer housing 17 comprising the outside of the connector housing 11 from the connector housing fitting direction as well as the packing 24 is inserted and set in the packing receiving part 25 of the inner wall part 17*a* of the outer housing 17.

Then, as shown in FIG. 10B, the body 28*a* of the spacer 28 is fitted into the inner wall part 17*a* of the outer housing 17 so that each engagement claw 32 of the body 28*a* of the spacer 28 is engaged with each engagement hole 23 of the inner wall part 17*a* of the outer housing 17. According to the engagement of each engagement hole 23 of the inner wall part 17*a* of the outer housing 17 and each engagement claw 32 of the body 28*a* of the spacer 28, fall-off of each rubber plug 18 is prevented by the bottom wall part 17*c* of the outer housing 17 as well as fall-off of the packing 24 is prevented by the oblique tip end of the brim part 28*b* of the spacer 28 so that the water proof property of the connector housing as a whole can further be improved.

As shown in FIG. 10C, the electric wires 20 are inserted through each insertion hole 21 of the bottom wall part 17*c* of the outer housing 17, each rubber plug 18, and each insertion hole 33 of the bottom wall part 28*c* of the spacer 28 from the outside. Then, as shown in FIG. 10D, each electric wire 20 is press-connected with the pair of the press-connecting blades 14*b* of the female terminals 14 accommodated in each terminal chamber 13 of the inner housing 12 comprising the inner side of the connector housing 11.

As shown in FIG. 10E, the inner housing 12 is fitted into the body 28*a* of the spacer 28 so that each engagement claw 15 of the box part 12*a* of this inner housing 12 is engaged with each engagement hole 23 of the inner wall part 17*a* of the outer housing 17 so as to complete the assembly of the water proof connector 10". At the time, since the rear end rim of the box part 12*a* of the inner housing 12 and the rear end rim of the box part 14*a* of the female terminals 14 accommodated in each terminal chamber 13 are locked according to each projection 29 projecting to the inner face of the upper and lower walls of the body 28*a* of the spacer 28 as well as each projection 29 cannot deform outward, fall-off of the female terminals 14 from each terminal chamber can be prevented certainly. Besides, since the spacer 28 can hold each female terminal 14 and each rubber plug 18 at the same time, a component dedicated to prevention of fall-off of the rubber plug can be eliminated, and thus a low cost can be achieved by cutback of the number of the components. Furthermore, since the spacer 28 can be locked doubly according to the engagement of each engagement claw 32 of the spacer 28 itself with each engagement hole 23 of the outer housing 17 and the engagement of each engagement claw 15 o the inner housing 12 with each engagement hole 23 of the outer housing 17, fall-off of each rubber plug 18 and the packing 24 can be prevented certainly so that the water proof reliability can further be improved.

However, according to the related water proof connector 10", since the rubber plugs 18 are accommodated preliminarily in the rubber plug chambers 19 of the outer housing 17 as shown in FIG. 10B, the electric wires 20 can easily be bent due to the sliding friction between the rubber plugs 18 and the electric wires as shown in FIG. 11 at the time of the electric wire insertion by inserting the electric wires 20 through the insertion holes 21 of the outer housing 17 and the insertion holes 33 of the spacer 28 shown in FIGS. 10B to 10C, and at the time of fitting the housing by sliding the electric wires 20 with respect to the insertion holes 33 of the spacer 28 and the insertion holes 21 of the outer housing 17 so as to fit the inner housing 12 into the spacer 28 fitted inside the outer housing 17 shown in FIGS. 10D to 10E so that there is a risk of causing a trouble in the wire harness production. That is, there is a risk of deteriorating the assembly operativity of the water proof connector 10" due to the increased operation load by the sliding friction between the rubber plugs 18 and the electric wires 20 at the time of the electric wire inserting operation of the electric wires 20 and the housing fitting operation of fitting the inner housing 12 into the outer housing 17 side.

SUMMARY OF THE INVENTION

Accordingly, in order to solve the above-mentioned problems, an object of the invention is to provide a small size multi-way water proof connector with an improved assembly operativity, and a method of assembling the same.

In order to achieve the above object, according to the present invention, there is provided a waterproof connector comprising:

- a waterproof rubber plug having a through hole through which an electric wire is inserted;
- a terminal to which the electric wire is connected;
- an inner housing having a terminal chamber for accommodating the terminal;
- an outer housing having sidewalls for defining a chamber provided with a bottom wall, into which the inner housing is fitted;
- a through hole, through which the electric wire is inserted, formed on the bottom wall so as to face the terminal chamber when the inner housing is inserted into the chamber of the outer housing; and
- a recess formed on the bottom wall so as to communicate with the through hole and opened to the outside of the outer housing, into which the rubber plug is fitted after the inner housing is completely fitted into the chamber of the outer housing, thereby sealing the electric wire and the terminal chamber.

According to the above configuration, since the rubber plug can be accommodated in the recess of the outer housing from the outside thereof after connecting the electric wire placed through the through holes of the outer housing with the terminal accommodated in the terminal chamber of the inner housing and fitting the inner housing into the outer housing, the friction between the electric wire and the rubber plug can be eliminated at the time of fitting the inner housing into the inside of the outer housing so as to prevent generation of bend of the electric wire, and thus the assembly operativity of the water proof connector can be improved. That is, production of the wire harness can be facilitated.

Preferably, a hook member is formed an inner wall of the recess for retaining the rubber plug inside of the recess.

According to the above configuration, fall-off of the rubber plug accommodated in the recess of the outer housing from the outside thereof can be prevented certainly.

Preferably, the waterproof connector further comprises a leverage member pivotably provided on the outside of the outer housing for press-fitting the rubber plug into the recess by the leverage action thereof.

According to the above configuration, the press-fitting operation of the rubber plug can be executed easily with a small operation force of the leverage member in a short time so that the assembly operativity of the water proof connector can be improved. Accordingly, production of the wire harness can be facilitated.

According to the present invention, the above waterproof connector is assembled by the steps of:

- passing the electric wire through the through hole of the rubber plug;
- passing the electric wire through the through hole on the bottom wall of the outer housing while staying the rubber plug outside of the outer housing;

connecting the electric wire to the terminal;

fitting the terminal into the terminal chamber of the inner housing;

fitting the inner housing into the chamber of the outer housing; and fitting the rubber plug into the recess of the outer housing.

According to the above configuration, the electric wire is in a free state without being slid with the rubber plug at the time of inserting the electric wire through the through hole of the outer housing and at the time of fitting the inner housing into the chamber of the outer housing, and thus the assembly can be executed smoothly without generation of bend of the electric wire so as to drastically alleviate the operation load of the electric wire insertion force and the housing fitting force. Accordingly, a waterproof connector having the excellent water proof property can be assembled easily in a short time, and thus the assembly operativity as a whole can further be improved.

Preferably, the rubber plug is press-fitted into the recess by leverage action of a leverage member pivotably provided on the outside of the outer housing.

According to the above configuration, the press-fitting operation of the rubber plug can be executed easily with a small operation force of the leverage member in a short time so that the assembly operativity of the water proof connector can be improved. Accordingly, production of the wire harness can be facilitated.

DETAILED DESCRIPTION OF THE PREFERRED EMBODIMENTS

Figure 1:
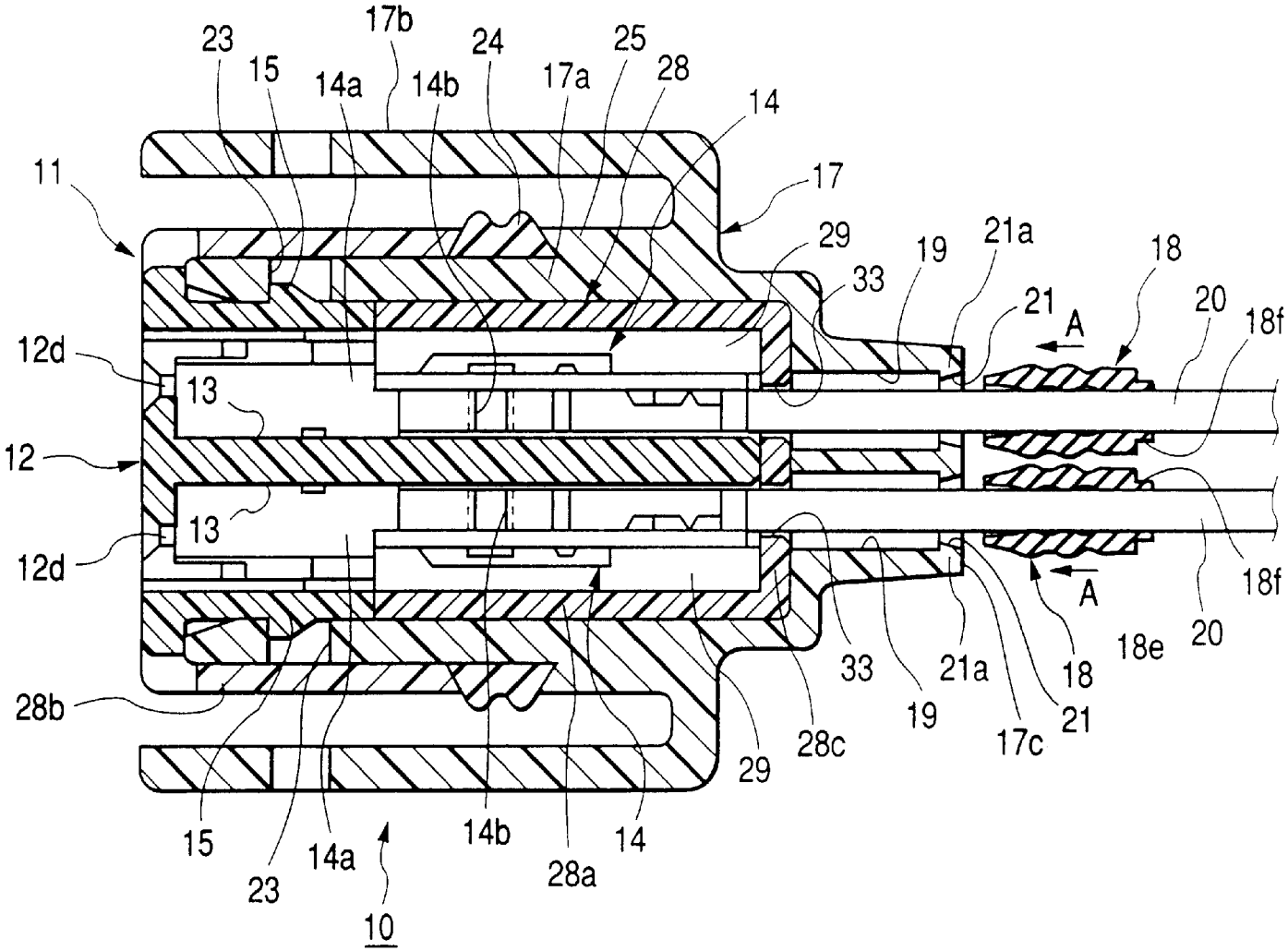
FIG. 1 is a cross-sectional view showing a water proof connector according to a first embodiment of the invention in a state before assembling rubber plugs.

Hereinafter a first embodiment of the invention will be explained with reference to the drawing.

Figure 5A:
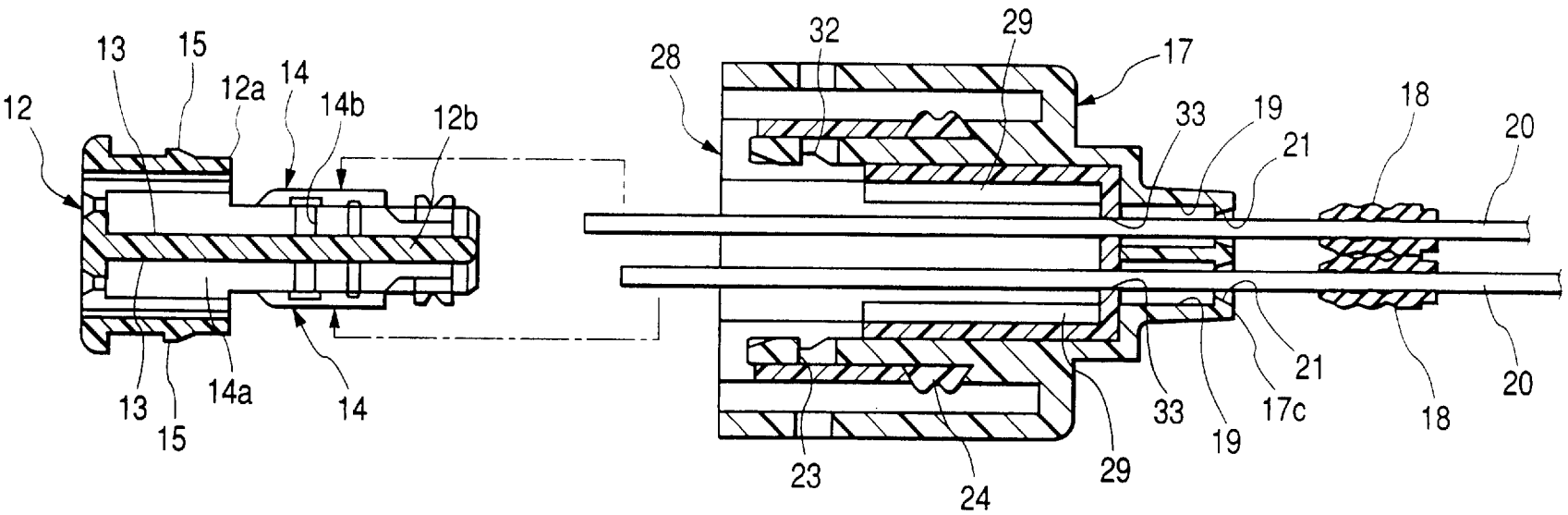
FIG. 5A is a cross-sectional view showing a state that electric wires are preliminarily placed through the rubber plugs inserted through the outer housing and a spacer.
Figure 5B:
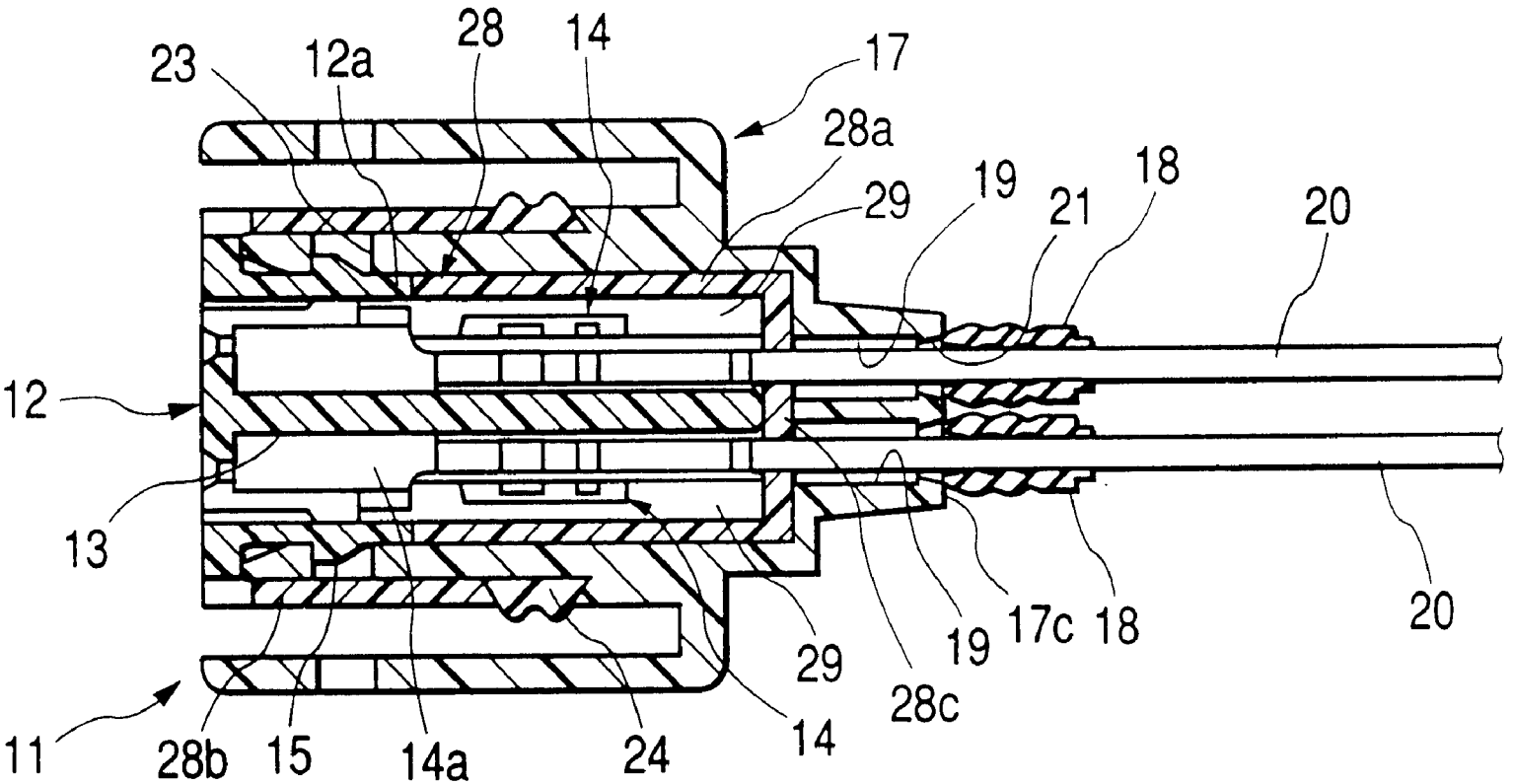
FIG. 5B is a cross-sectional view showing a state before fitting the rubber plugs into the rubber plug chambers from the outside.
Figure 5C:
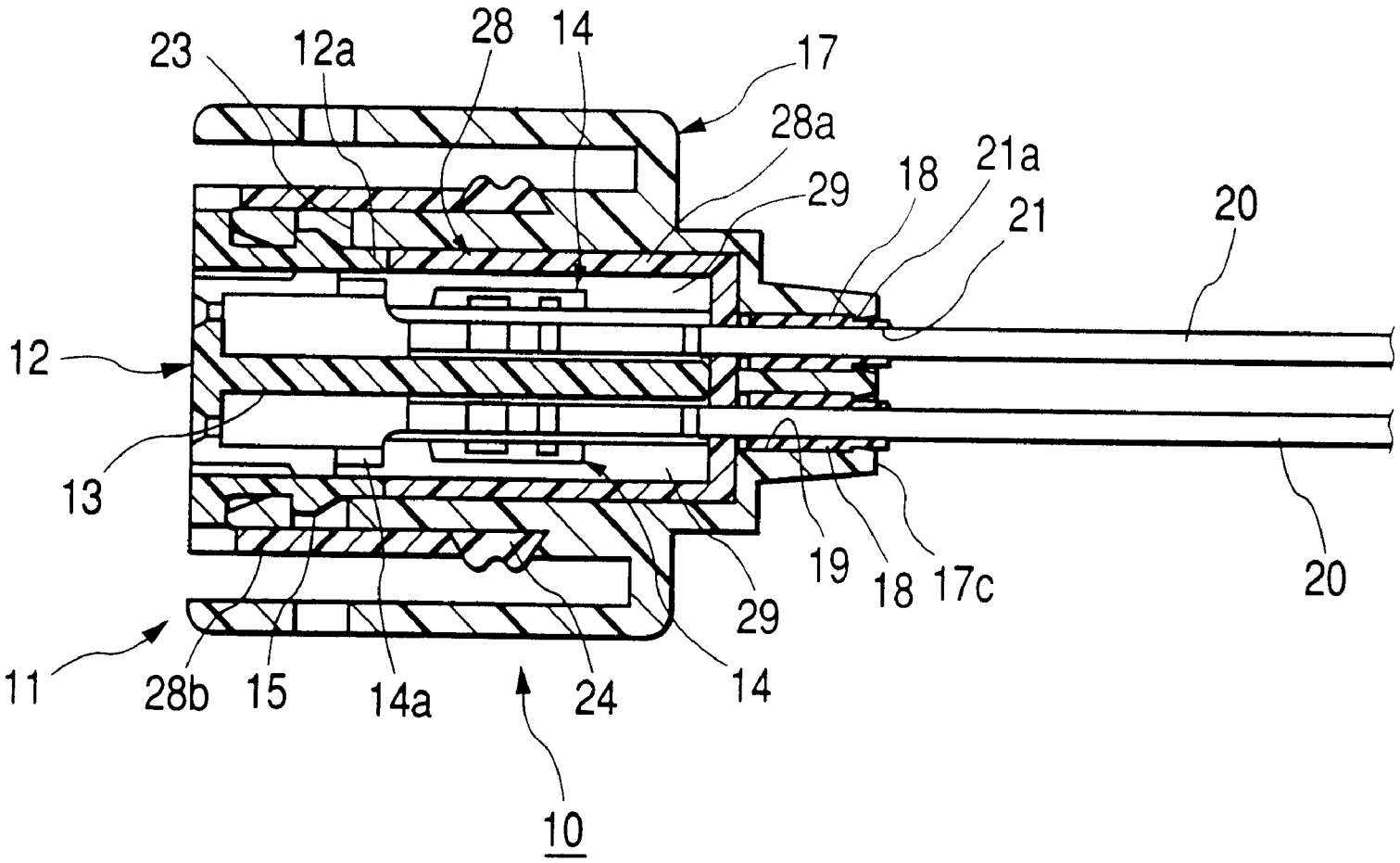
FIG. 5C is a cross-sectional view showing a state after completing the assembly of the water proof connector.

As shown in FIGS. 1 and 5, similar to the case of the related waterproof connector, a connector housing 11 of a water proof connector 10 comprises a synthetic resin inner housing 12 having a plurality of terminal chambers 13 formed integrally therewith, a synthetic resin outer housing 17 for fitting the inner housing 12 to the inside thereof, and a synthetic resin spacer 28 to be fitted into the outer housing 17 for holding a water proof packing 24 for sealing a mating connector (not illustrated). The same components as in the related water proof connector 10" are applied with the same numerals.

Figure 2:
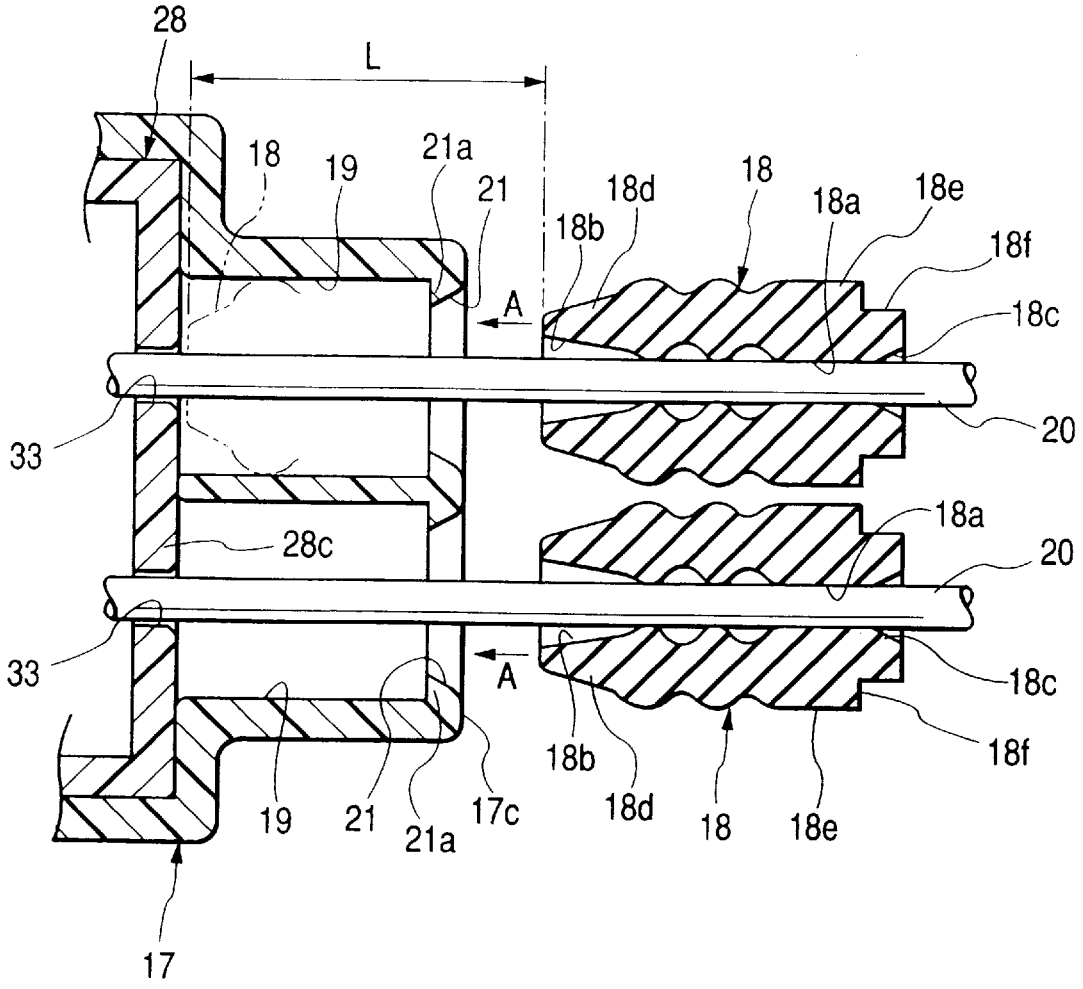
FIG. 2 is a partial cross-sectional view showing a state before fitting the rubber plugs into rubber plug chambers of an outer housing of the waterproof connector shown in FIG. 1.

As shown in FIGS. 1 and 2, the rubber plugs 18 are accommodated with pressure in each rubber plug chamber 19 inside the bottom wall part 17*c* of the outer housing 17 along the electric wires 20 from the direction A outside the outer housing 17 so as to complete the assembly of the water proof connector 10. When the rubber plugs 18 are press-fitted into each of the rubber plug chambers 19 of the outer housing 17 from the outside, as shown in FIG. 2, since the sliding distance L of the rubber plugs 18 with respect to the electric wires 20 is short, bend of the electric wires 20 can hardly be generated, and thus the assembly of the water proof connector 10 can be improved. Moreover, as show on in FIGS. 3 and 4, since the rubber plugs 18 accommodated in each of the rubber plug chambers 19 of the outer housing 17 are engaged by the hood portion 21*a* around each through hole 21 of the outer housing, the rubber plugs 18 will not fall out of each rubber plug chamber of the outer housing 17 to the outside.

Figure 3:
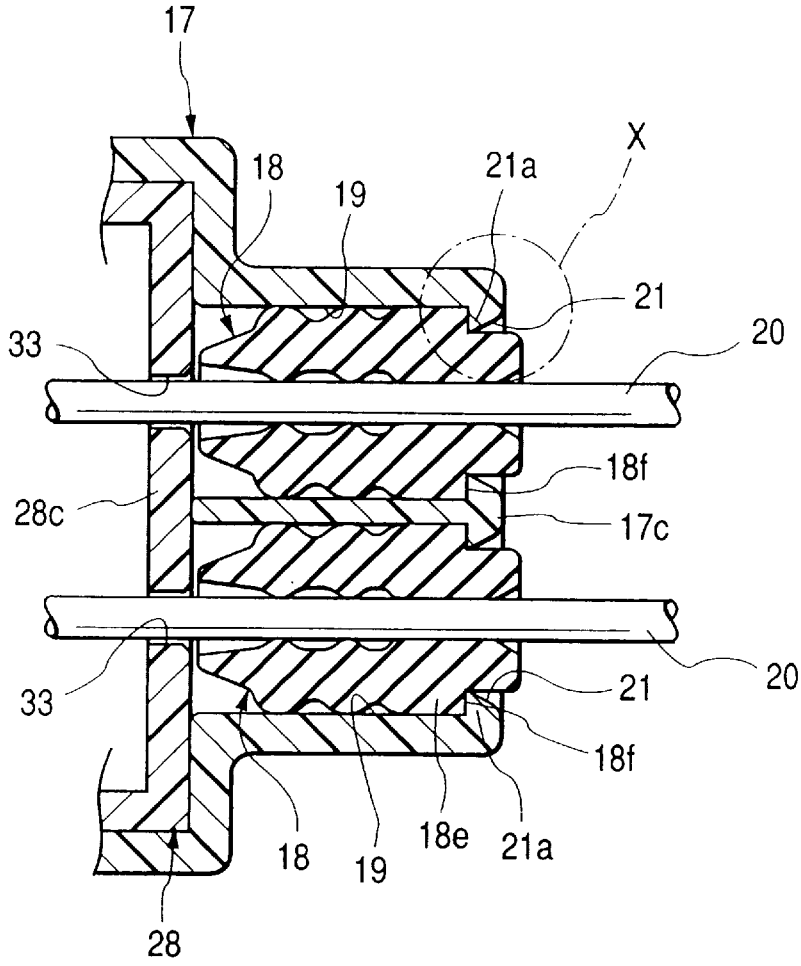
FIG. 3 is a partial cross-sectional view showing a state that the rubber plugs are fitted into the rubber plug chambers.
Figure 4:
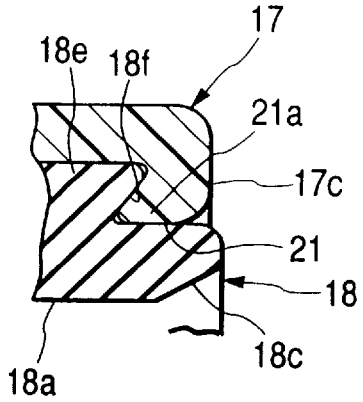
FIG. 4 is an enlarged cross-sectional view of the X portion of FIG. 3.

As shown in FIGS. 2 and 3, reverse conical faces 18*b* are formed on both end sides of the through holes 18*a* of the rubber plugs 18 with the electric wires 20 inserted therethrough. The face (inner peripheral face) of the through holes 18*a* and the outer peripheral face of the rubber plugs have a rugged shape so that the electric wires can be inserted through the inside of the through holes 18*a* without having a gap. Moreover, a conical face 18*d* is formed on the outer periphery of the front side of the rubber plugs 18 for facilitating the insertion into the rubber plug chambers 19. Furthermore, an annular engagement recess 18*f* is formed on the rear end of a body 18*e* at the outer periphery of the rear side of the rubber plugs 18. As shown in FIGS. 3 and 4, when the rubber plugs 18 are accommodated in the rubber plug chambers 19 of the outer housing 17, the rubber plugs 18 are engaged such that the hook portion 21*a* around each through hole 21 of the outer housing 17 cuts into the engagement recess 18*f* of the body 18*e* of the rubber plugs 18. Since the other parts of the configuration are the same as those of the related water proof connector 10", the same components are applied with the same numerals and further explanation is not provided herein.

In assembling the water proof connector 10 of this embodiment, the packing 24 is inserted and set preliminarily into the packing receiving part 25 of the inner wall part 17*a* of the outer housing 17 comprising the outside of the connector housing 11 as well as each electric wire 20 is inserted through the rubber plug 18 preliminarily at the outside of the bottom wall part 17*c* of the outer housing. Then, as shown in FIG. 5A, the electric wires 20 are inserted through the plurality of the through hole 21 of the bottom wall part 17*c* of the outer housing 17 from the outside thereof as well as they are inserted through each through hole 33 of the bottom wall part 28*c* of the spacer 28.

The electric wires 20 are pressure welded with a pair of the pressure blades 14*b* of each terminal 14 accommodated in the plurality of the terminal chambers 13 of the inner housing 12 comprising the inside of the connector housing 11. By pulling the electric wires 20 to the outside direction with respect to the outer housing so as to slide with each through hole 33 of the bottom wall part 28*c* of the spacer 28 and each through hole 21 of the bottom wall part 17*c* of the outer housing 17, the inner housing 12 is fitted into the inside of the body 28*a* of the spacer 28 as shown in FIG. 5B for fitting the inner housing 12 and the outer housing 17 via the spacer 28.

As shown in FIGS. 1 and 2, the rubber plugs 18 are accommodated with pressure in each rubber plug chamber 19 inside the bottom wall part 17*c* of the outer housing 17 along with the electric wires 20 from the direction A outside the outer housing 17 so as to complete the assembly of the water proof connector 10. When the rubber plugs 18 are press-fitted into each rubber plug chamber 19 of the outer housing 17 from the outside, as shown in FIG. 2, (the sliding distance L of the rubber plugs 18 with respect to the electric wires 20 is short) a bend of the electric wires 20 can hardly be generated, and thus the assembly of the water proof connector 10 can be improved. Moreover, as shown in FIGS. 3 and 4, since the rubber plugs 18 accommodated in each rubber plug chamber 19 of the outer housing 17 are engaged certainly by the hook portion 21*a* around each through hole 21 of the outer housing, the rubber plugs 18 cannot fall off from each rubber plug chamber of the outer housing 17 to the outside.

Accordingly, since the rubber plugs 18 are accommodated in each rubber plug chamber 19 of the outer housing 17 after fitting the inner housing 12 and the outer housing 17 via the spacer 28, since the electric wires 20 are in the free state without being slid with the rubber plugs 18 at the time of inserting the electric wires 20 through each through hole 21 of the outer housing 17 and at the time of fitting the inner housing 12 with the outer housing 17 via the spacer 28, the assembly can be executed smoothly without generation of bend of the electric wires 20 so as to drastically alleviate the operation load of the electric wire insertion force and the housing fitting force. Accordingly, the multi-way water proof connector 10 having the excellent water proof property can be assembled easily in a short time. That is, production of a wire harness comprising a bundle of the electric wires 20 can be facilitated, and thus the assembly operativity as a whole can further be improved.

Figure 6:
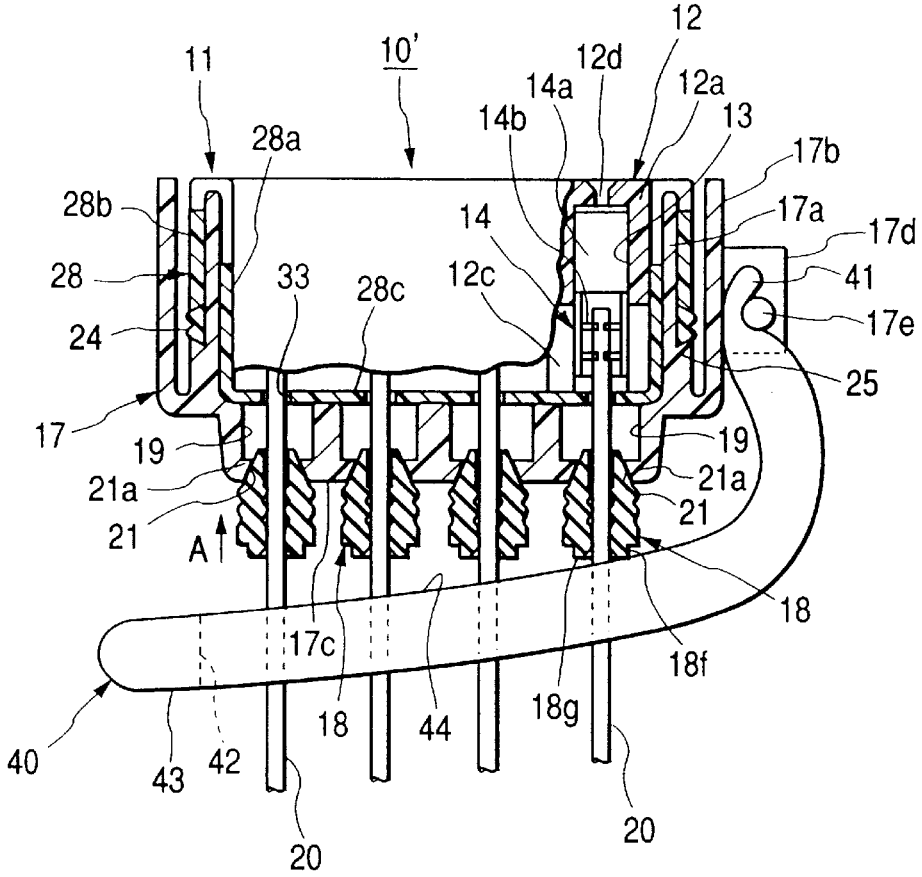
FIG. 6 is a lateral cross-sectional view showing a state before fitting rubber plugs into rubber plug chambers from the outside of a water proof connector according to a second embodiment of the invention.
Figure 7:
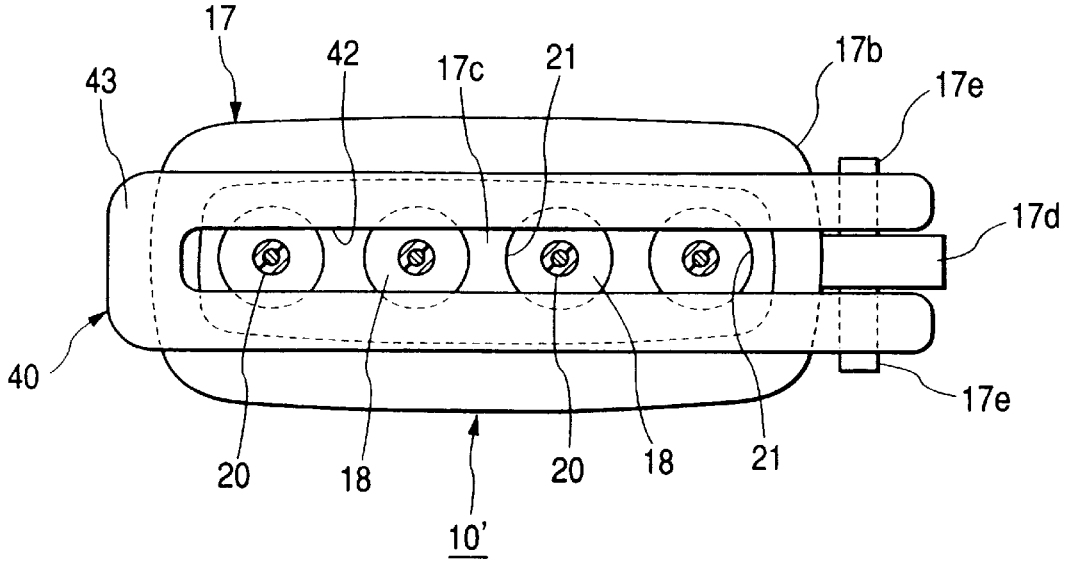
FIG. 7 is an explanatory diagram of the water proof connector of FIG. 6, viewed from a rubber plug insertion member side.
Figure 8:
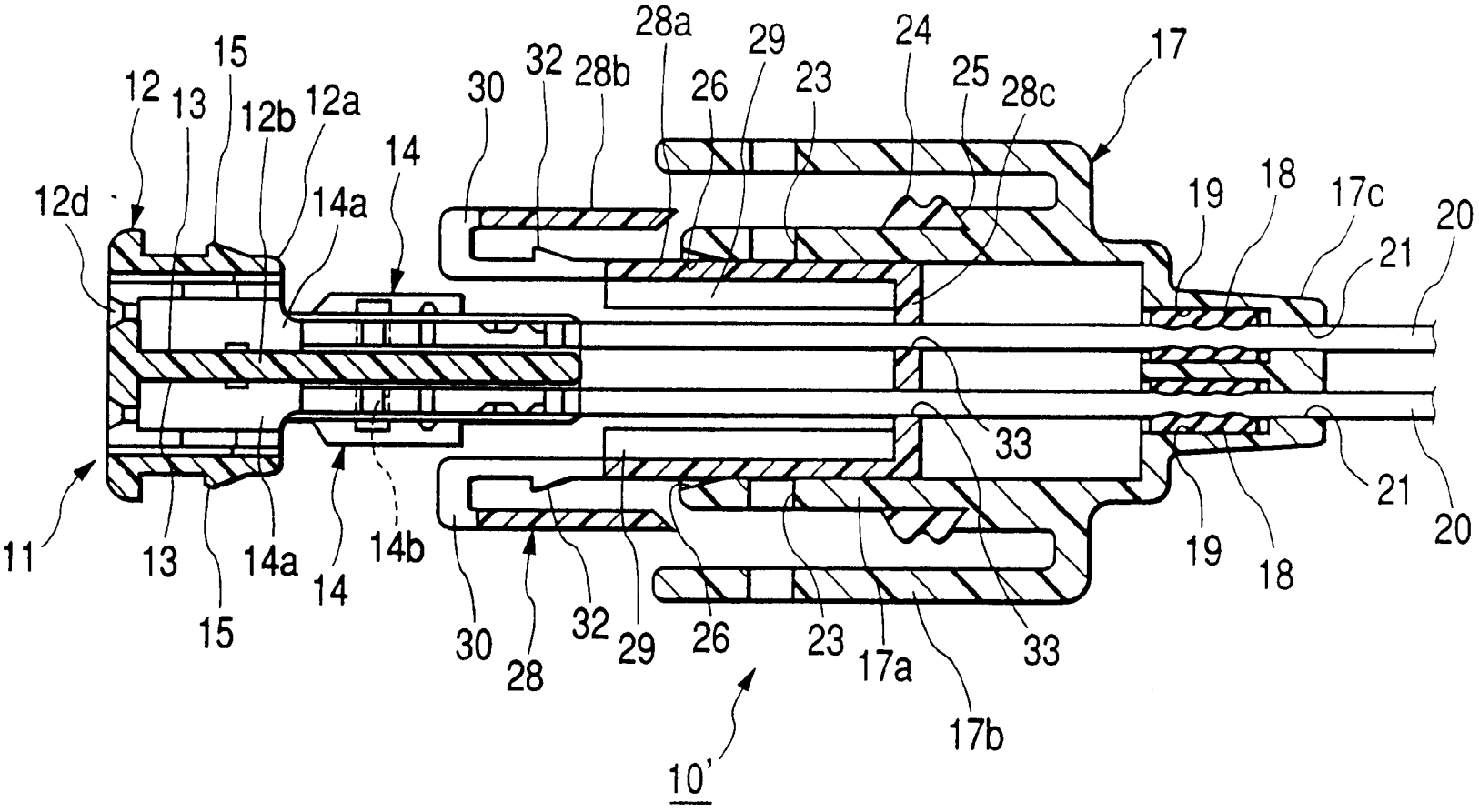
FIG. 8 PRIOR ART
FIG. 8 is a cross-sectional view of a related water proof connector in a state before assembled.
Figure 9:
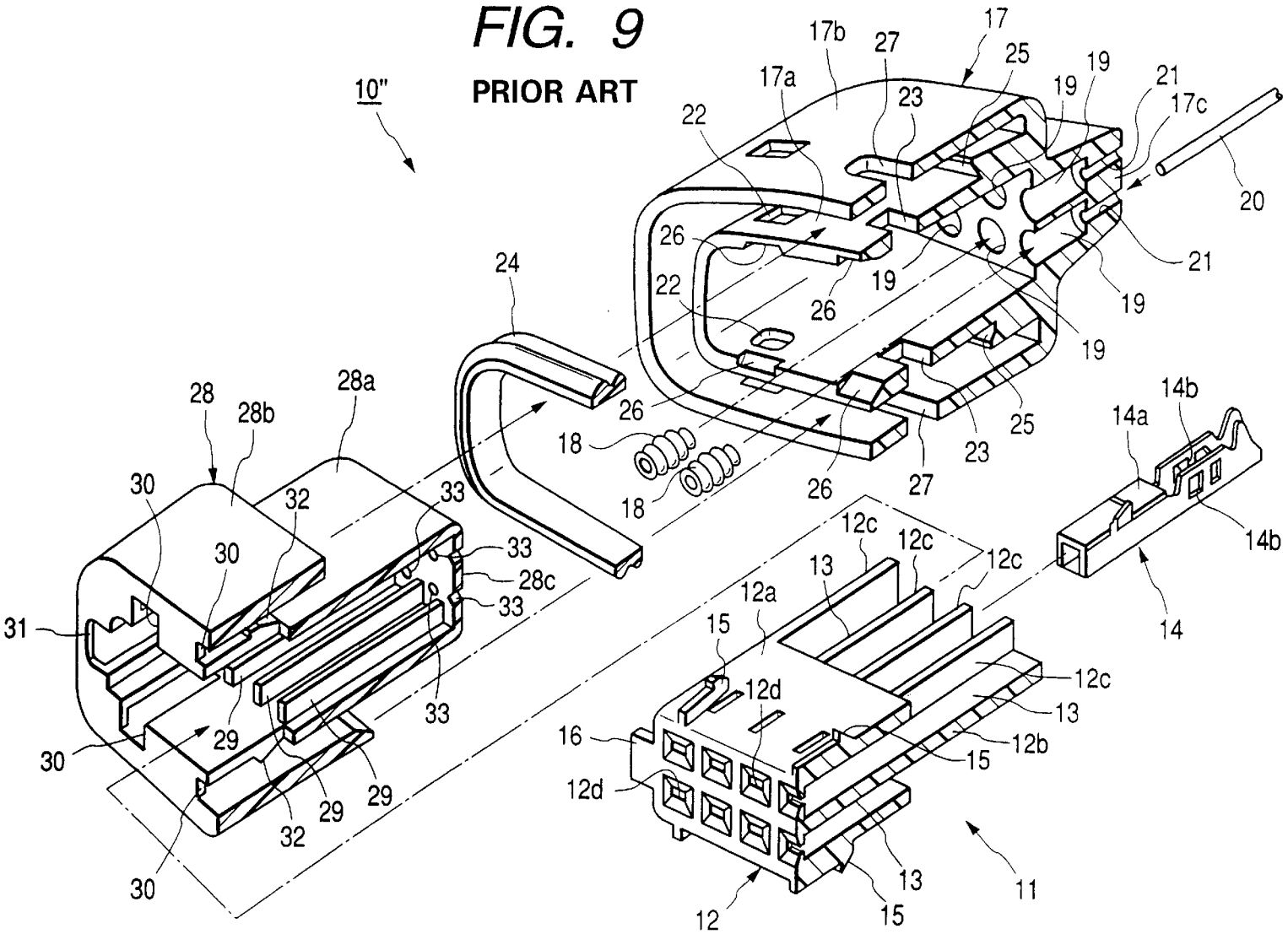
FIG. 9 PRIOR ART
FIG. 9 is a perspective view with a partial cross-section of FIG. 2.
Figure 10A:
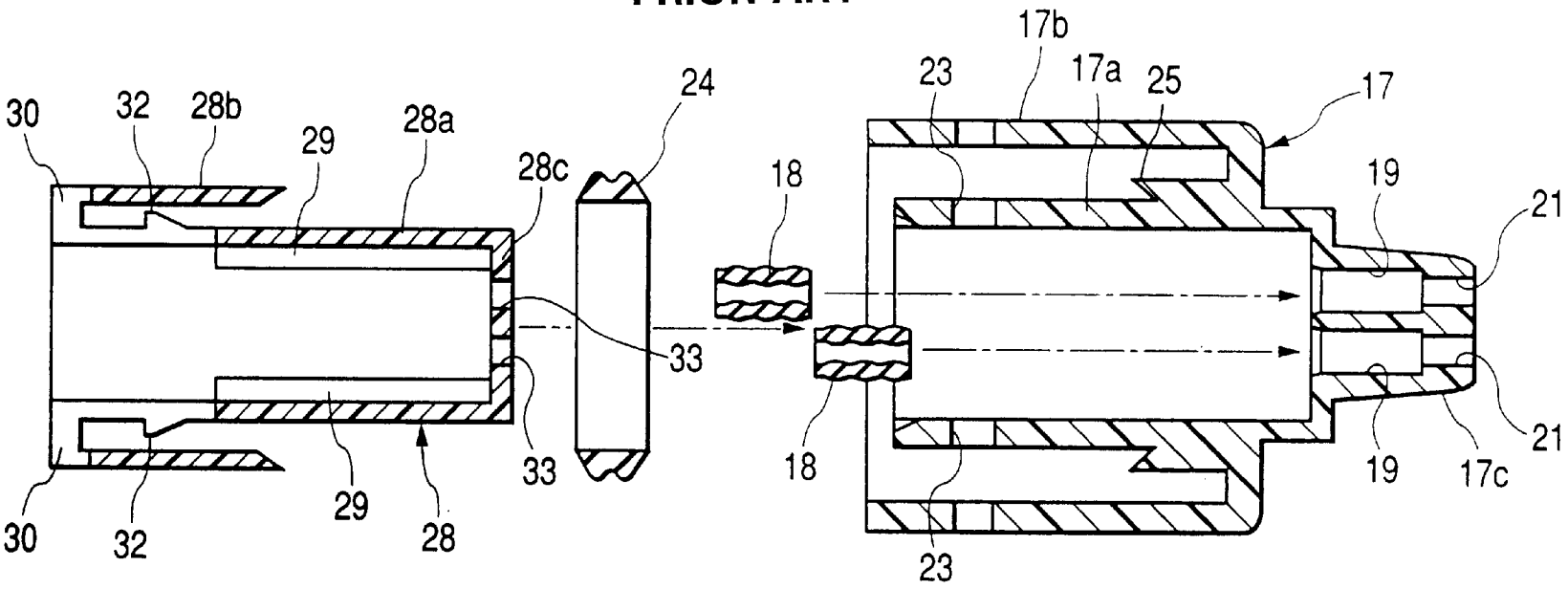
FIG. 10A PRIOR ART
FIG. 10A is a cross-sectional view of the related water proof connector in the state before assembled.
Figure 10B:
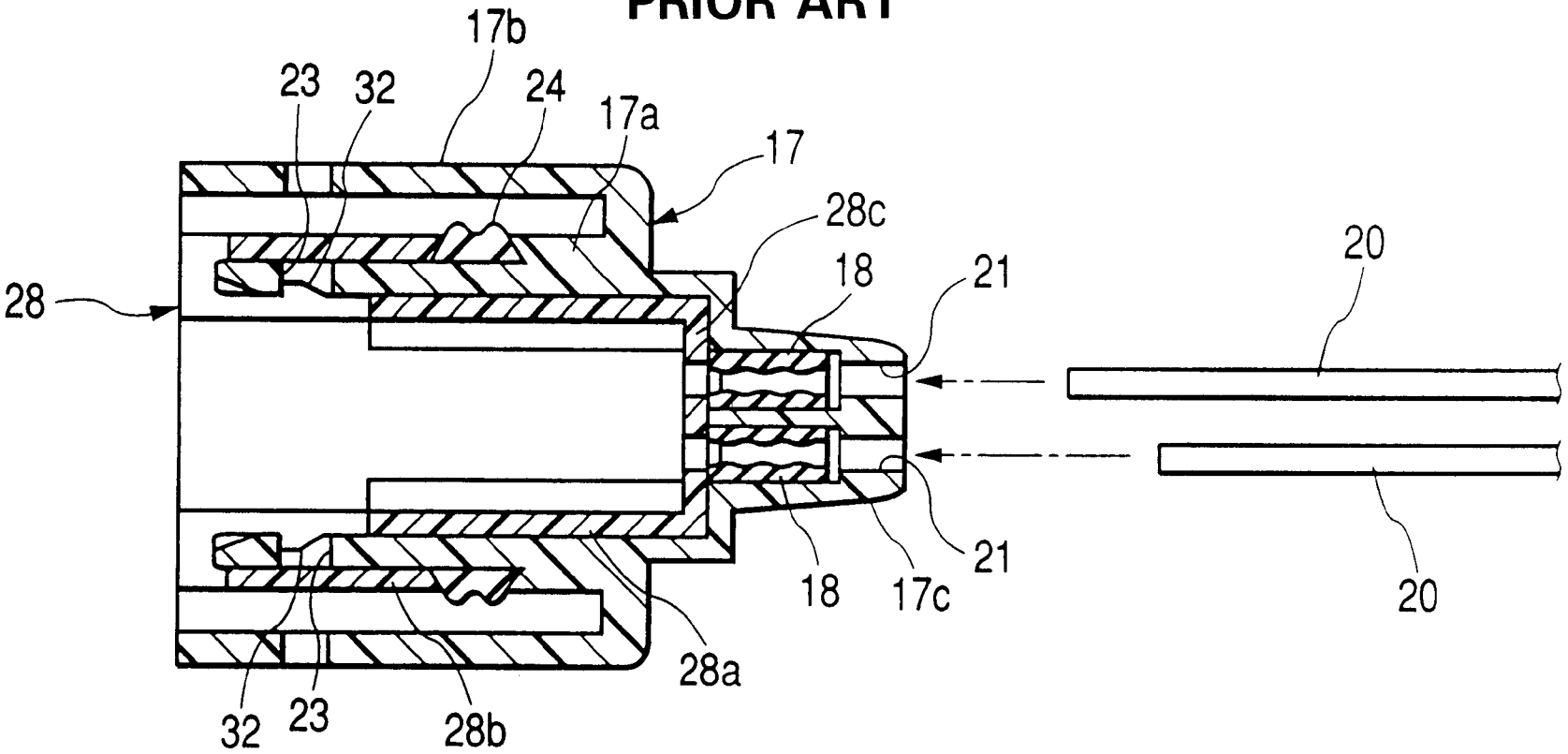
FIG. 10B PRIOR ART
FIG. 10B is a cross-sectional view of the related water proof connector showing a state with a spacer fitted in an outer housing.
Figure 10C:
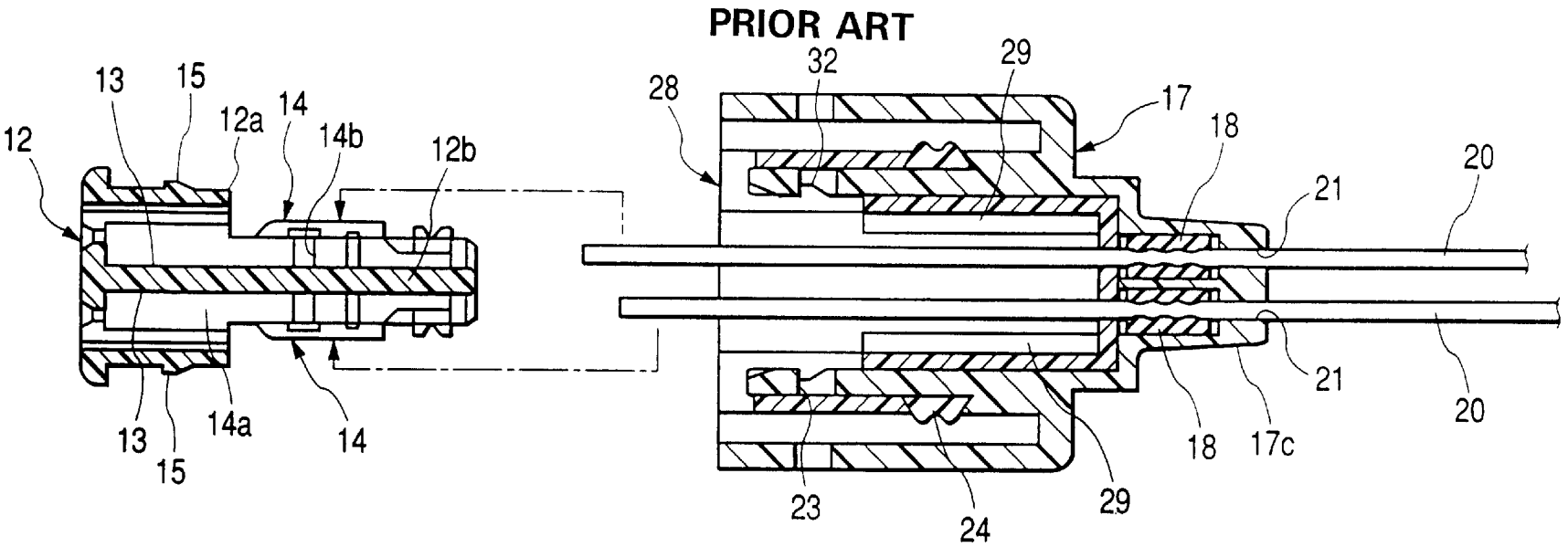
FIG. 10C PRIOR ART
FIG. 10C is a cross-sectional view showing a state with electric wires inserted through and outer housing and the spacer.
Figure 10D:
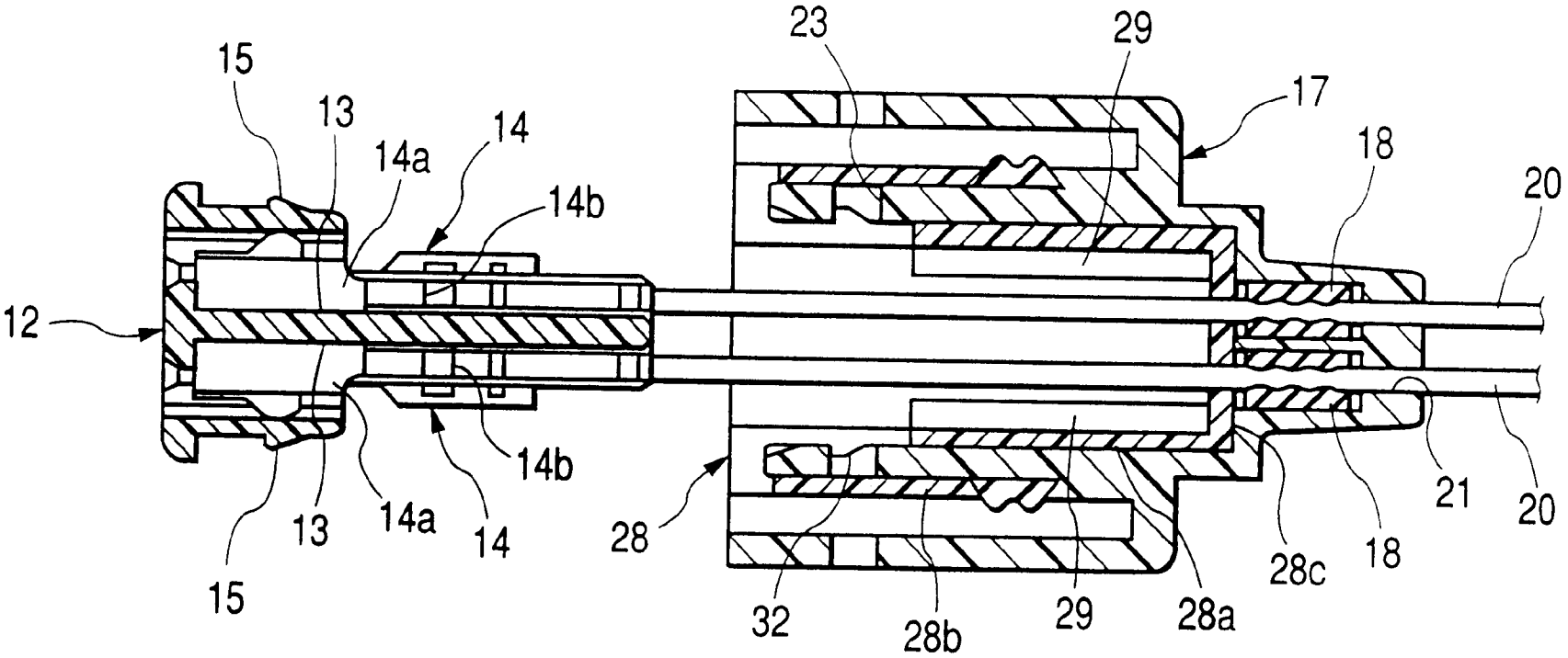
FIG. 10D PRIOR ART
FIG. 10D is a cross-sectional view showing a state with the electric wires connected with terminals accommodated in terminal chambers of an inner housing.
Figure 10E:
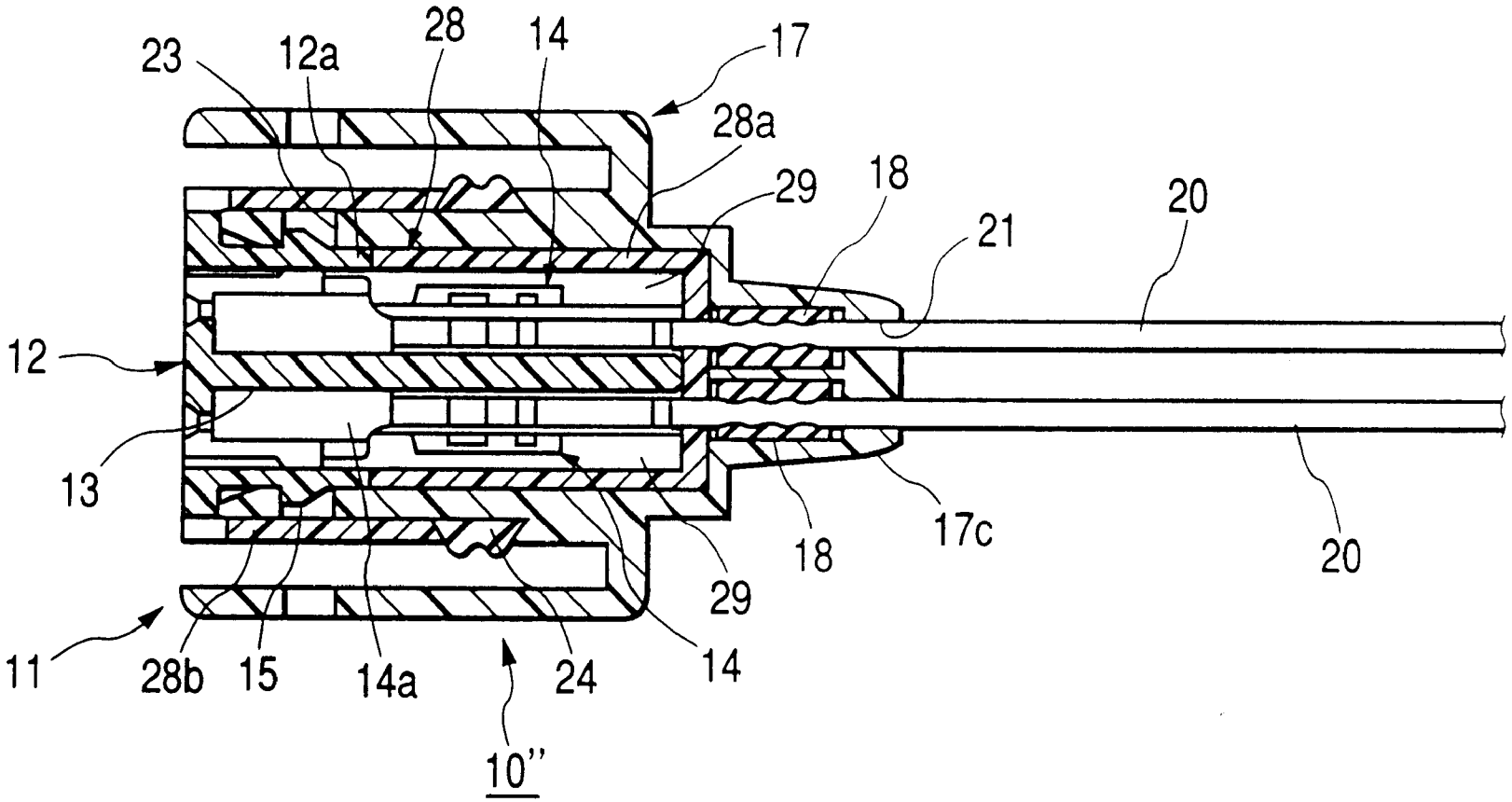
FIG. 10E PRIOR ART
FIG. 10E is a cross-sectional view showing a state after completing the assembly of the related water proof connector.
Figure 11:
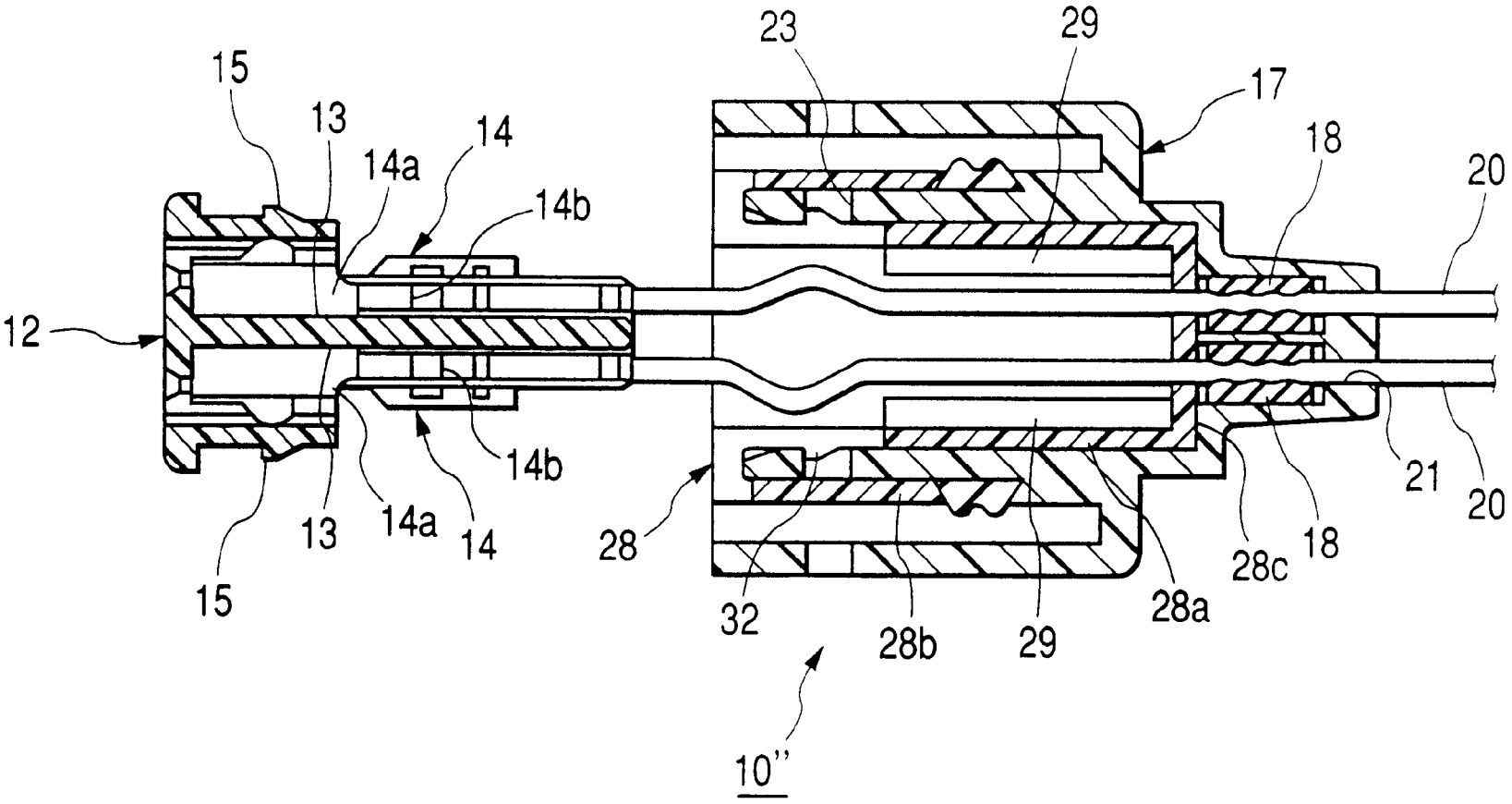
FIG. 11 PRIOR ART
FIG. 11 is a cross-sectional view showing a state before fitting the inner housing into the spacer fitted in the inside of the outer housing of the related water proof connector.

FIG. 6 is a lateral cross-sectional view showing a state before fitting rubber plugs into rubber plug chambers of an outer housing from the outside of a water proof connector according to a second embodiment of the invention. FIG. 7 is an explanatory diagram of the water proof connector, viewed from a rubber plug insertion member side.

A water proof connector 10' of this embodiment is for successively storing the rubber plugs 18 by pressure into each rubber plug chamber 19 of the outer housing from the outside direction A, using a lever 40 rotatable around the spindle 17*e* of the outer housing 17. That is, a rectangular horizontal brim part 17*d* is formed integrally, projecting from one side face of the outer wall part 17*b* of the outer housing 17. A pair of columnar spindles 17*e* are formed integrally, projecting in the upper and lower direction on the upper and lower faces of the brim part 17*d*.

The lever 40 is made from a synthetic resin with a U-shaped front view, with the pair of the tip parts 41 formed with a curved shape having a substantially S-shaped side view. The pair of the tip parts 41 of the lever 40 are supported detachably by the pair of the spindles 17*e* of the outer housing 17 such that the lever 40 can rotate around each spindle 17*e* in the clockwise direction in FIG. 6. At the time, the electric wires 20 are inserted in a space 42 at the center of the lever 40. Since the configuration is same as that of the water proof connector 10 of the first embodiment except that the inner housing 12 to be fitted into the outer housing 17 via the spacer 28 comprises a plurality of the terminal chambers 13 adjacent with each other only in the right and left direction (horizontal direction), the same components are applied with the same numerals and further explanation is not given herein.

The water proof connector 10' of this embodiment can be assembled in the same manner as the assembling method for the water proof connector 10 of the first embodiment, but in storing the rubber plugs 18 into each rubber plug chamber 19 of the outer housing 17 from the outside direction A, the operation is executed by the leverage of the lever 40. That is, as shown in FIG. 6, since the rear faces 18*g* of the plurality of the rubber plugs 18 disposed in the horizontal direction are pushed successively by the pressing face 44 of the lever 40 with a small operation force of the operation part 43 of the lever 40 rotatable around the pair of the spindles 17*e* of the outer housing 11, the rubber plugs 18 can be accommodated in the plurality of the rubber plug chamber 19 of the outer housing 17 easily in a short time, and thus the assembling operativity of the water proof connector 10' can be improved. Accordingly, production of a wire harness comprising a bundle of the electric wires 20 can be facilitated, and thus the assembly operativity as a whole can further be improved.

Moreover, the lever 40 can be detached from the outer housing 17 after the assembly of the water proof connector 10' so as to be used repeatedly.

Although the case of pressure welding of the electric wires to the pressure terminals has been explained in the above-mentioned embodiments, the terminals are not limited to the pressure terminals, but the embodiments can also be adopted to the case of the pressure connection of the electric wires to crimp-style terminals.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A waterproof connector comprising:

a waterproof rubber plug having a through hole which an electric wire is inserted;

a terminal to which the electric wire is connected;

an inner housing having a terminal chamber for accommodating the terminal;

an outer housing having sidewalls for defining a chamber provided with a bottom wall, into which the inner housing is fitted;

a through hole, through which the electric wire is inserted, formed on the bottom wall so as to face the terminal chamber when the inner housing is inserted into the chamber of the outer housing; and a plug accommodating chamber formed on the bottom wall so as to communicate with the through hole and opened to the outside of the outer housing, into which the rubber plug is accommodated after the inner housing is completely fitted into the chamber of the outer housing, thereby sealing the electric wire and the terminal chamber.

2. The waterproof connected as set forth in claim 1, wherein a hook member is formed in an inner wall of the plug accommodating chamber for retaining the rubber plug inside of the plug accommodating chamber.

3. The waterproof connector as set forth in claim 1, further comprising a leverage member pivotably provided on the outside of the outer housing for press-fitting the rubber plug into the recess by the leverage action thereof.

4. A method for assembling the waterproof connector as set forth in claim 1, comprising the steps of:

passing the electric wire through the through hole of the rubber plug;

passing the electric wire through the through hole on the bottom wall of the outer housing while keeping the rubber plug outside of the outer housing;

connecting the electric wire to the terminal;

fitting the terminal into the terminal chamber of the inner housing;

fitting the inner housing into the chamber of the outer housing; and fitting the rubber plug into the plug accommodating chamber of the outer housing.

5. The assembling method as set forth in claim 4, wherein the rubber plug is press-fitted into the plug accommodating chamber by leverage action of a leverage member pivotably provided on the outside of the outer housing.

* * * * *